US005294181A

United States Patent [19]

Rose et al.

[11] Patent Number: 5,294,181

[45] Date of Patent: Mar. 15, 1994

[54] SEAT CUSHION

[75] Inventors: Robert J. Rose, Chesterfield; Bruce Sleboda, Midlothian, both of Va.

[73] Assignee: E. R. Carpenter Company, Inc., Richmond, Va.

[21] Appl. No.: 823,536

[22] Filed: Jan. 21, 1992

Related U.S. Application Data

[63] Continuation-in-part of Ser. No. 817,680, Jan. 7, 1992.

[51] Int. Cl.[5] ..... A47C 7/18

[52] U.S. Cl. ..... 297/452.25; 297/452.57; 297/452.27; 297/DIG. 1; 5/653

[58] Field of Search ..... 297/DIG. 1, 452, 456, 297/458–460, DIG. 2, 453; 5/481, 652, 653, 464

[56] References Cited

U.S. PATENT DOCUMENTS

| | | | |
|---|---|---|---|
| D. 238,235 | 12/1975 | Elgebrandt | D6/9 |
| 1,843,893 | 2/1932 | Becher | 5/481 X |
| 2,831,532 | 4/1958 | Kasper . | |
| 3,000,020 | 9/1961 | Lombard et al. . | |
| 3,118,153 | 1/1964 | Hood . | |
| 3,393,012 | 7/1968 | Chancellor, Jr. | 297/458 |
| 3,513,491 | 5/1970 | Gordon | 5/481 X |
| 3,939,508 | 2/1976 | Hall et al. | 297/DIG. 1 X |
| 3,965,508 | 6/1976 | Hunter | 297/458 X |
| 3,987,507 | 10/1976 | Hall . | |
| 4,132,228 | 1/1979 | Green | 297/459 X |
| 4,143,916 | 3/1979 | Trotman et al. | 297/453 |
| 4,615,856 | 10/1986 | Silverman | 264/222 |
| 4,637,651 | 1/1987 | Sperr | 297/458 |
| 4,643,481 | 2/1987 | Saloff et al. | 297/458 |
| 4,646,374 | 3/1987 | Shafer | 5/481 |
| 4,753,480 | 6/1988 | Morell | 297/452 |
| 4,828,325 | 5/1989 | Brooks | 297/458 |
| 4,837,881 | 6/1989 | Kondo et al. | 297/459 X |
| 4,847,933 | 7/1989 | Bedford | 5/481 X |
| 4,879,776 | 11/1989 | Farley | 5/464 X |
| 4,951,334 | 8/1990 | Maier | 297/459 X |
| 4,953,913 | 9/1990 | Graebe | 297/459 |
| 4,960,304 | 10/1990 | Frantz | 297/DIG. 1 X |
| 5,022,111 | 6/1991 | Fenner, Sr. | 5/464 X |
| 5,079,790 | 1/1992 | Pouch | 297/DIG. 1 X |
| 5,160,785 | 11/1992 | Davidson, Jr. | 297/DIG. 1 X |
| 5,163,737 | 11/1992 | Navach et al. | 297/459 |

FOREIGN PATENT DOCUMENTS

| | | | |
|---|---|---|---|
| 3223197 | 12/1983 | Fed. Rep. of Germany | 297/458 |
| 3810980 | 10/1989 | Fed. Rep. of Germany | 297/458 |

*Primary Examiner*—James R. Brittain
*Assistant Examiner*—Milton Nelson, Jr.
*Attorney, Agent, or Firm*—Beveridge, DeGrandi, Weilacher & Young

[57] ABSTRACT

A seat cushion is described which has particular utility as a wheelchair seat cushion. The seat cushion includes a base layer of polyurethane foam with a front edge of greater height than the rear edge so as to define a downwardly sloping upper surface. The base layer supports an essentially constant thickness intermediate layer which is less firm than the base layer. The intermediate layer has a pair of laterally spaced recesses formed in the forward end of the intermediate layer which curve both upwardly and inwardly from the front edge of the intermediate layer. A top layer is secured to the intermediate layer and has a constant thickness. The top layer is formed of foam material which is less firm (e.g., a lower 65% IFD value) than the foam forming the intermediate layer. The intermediate layer is formed of a foam which is less firm (e.g., a lower 65% IFD value) than the material forming the base layer. The upper surface of the top layer defines a pair of depressions in the areas where the top layer is received within the recesses of the intermediate layer. The top layer includes a convoluted upper surface and in one embodiment the top layer includes a similarly convoluted extension which provides a backrest.

31 Claims, 4 Drawing Sheets

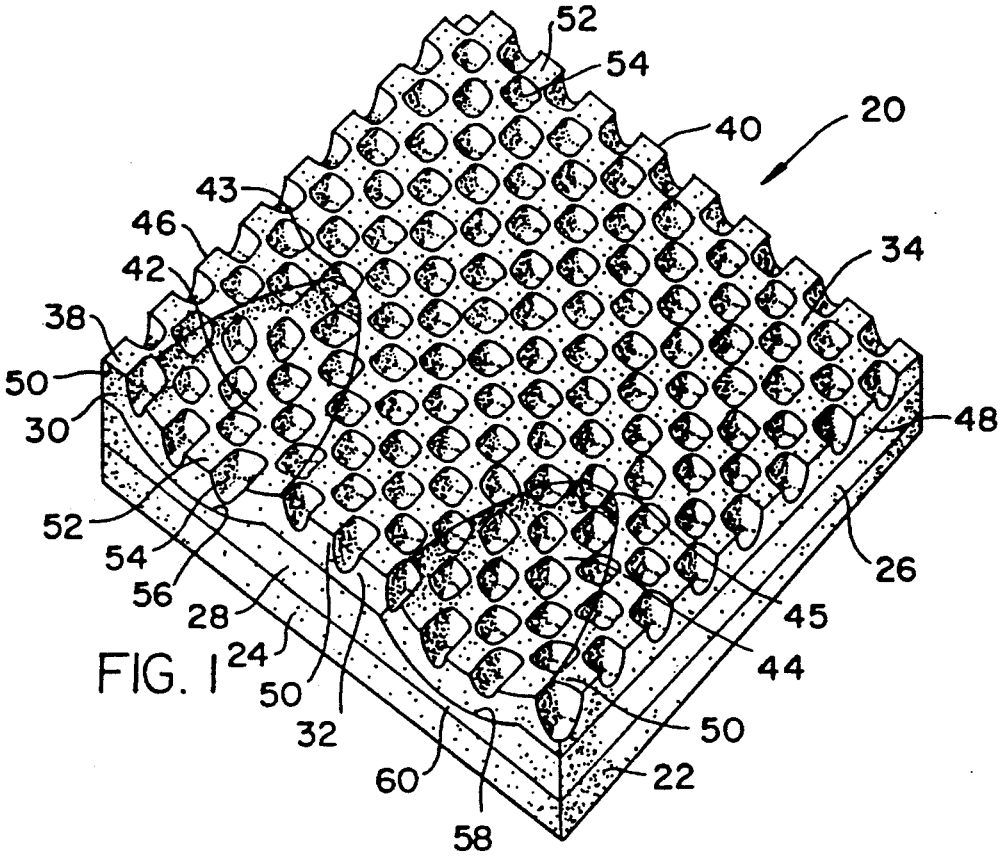
FIG. 1
FIG. 2
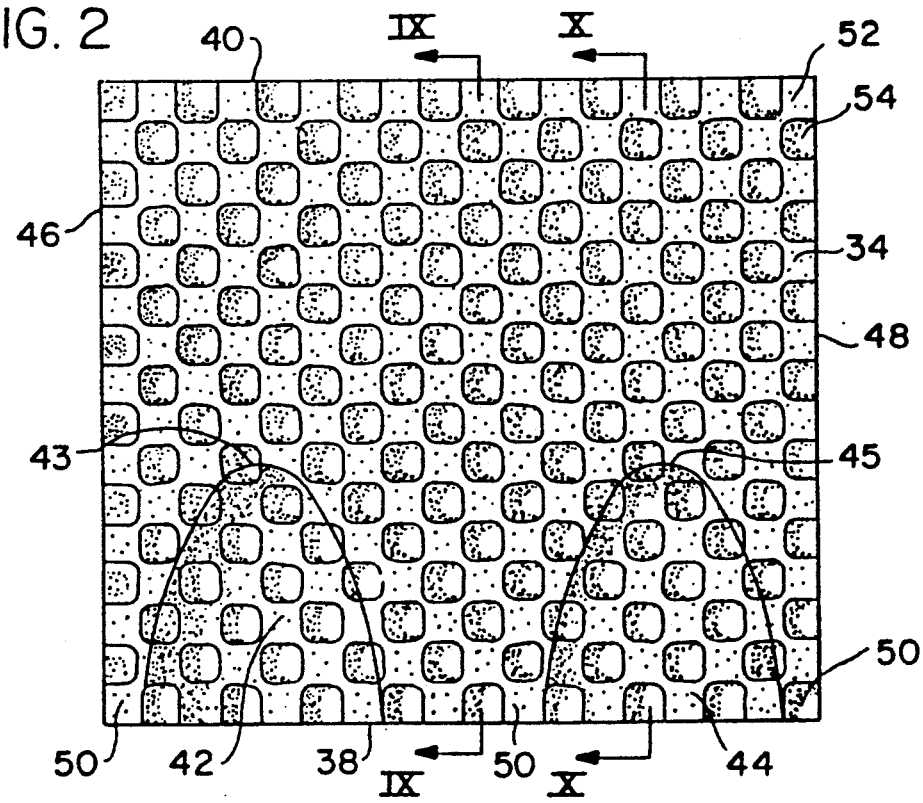

FIG. 6
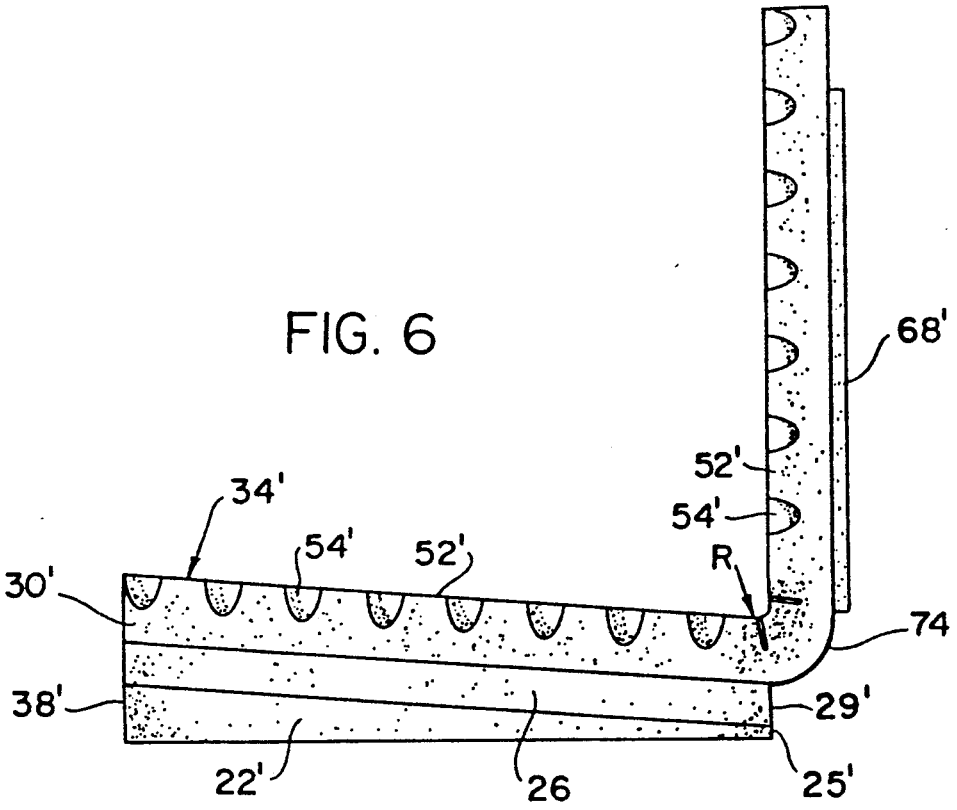
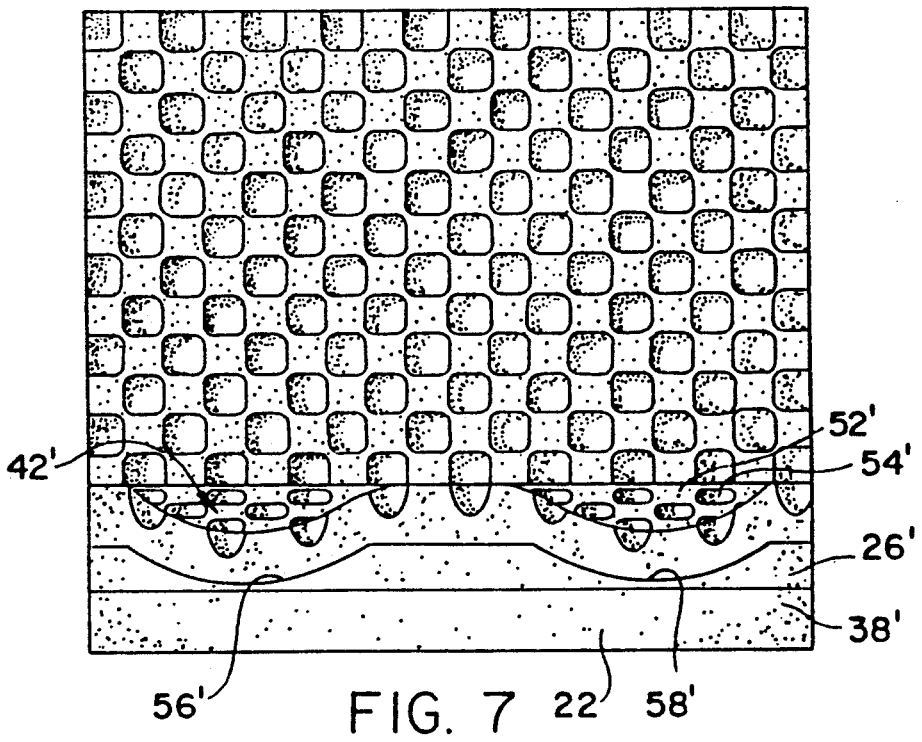
FIG. 7

SEAT CUSHION

The present application is a continuation-in-part of U.S. Ser. No. 07/817,680 filed Jan. 7, 1992.

FIELD OF THE INVENTION

This invention relates to a seat cushion which is particularly suitable for use as a wheelchair seat cushion.

BACKGROUND DISCUSSION

Numerous prior art attempts have been made to provide seat cushions which are comfortable, stable, and able to avoid the development of pressure sores due to prolonged use. Providing a seat cushion which is comfortable, stable, and able to avoid pressure sores, is of particular importance to wheelchair bound individuals as those individuals spend extended periods of time on the cushion and, in many cases, are of poor heath (e.g., convalescents). Individuals who spend extended periods of time upon a wheelchair seat cushion and who are of poor heath are highly susceptible to decubitus ulcers. Moreover, convalescents and the like often have to be strapped into a wheelchair in order to prevent the individual from falling forward and out of the wheelchair. The straps used to prevent the individuals from falling forward are kept relatively tight to achieve their retention purpose. The straps are thus not only uncomfortable, but can also lead to the formation of sores in the area where the straps are in contact with the individual.

U.S. Pat. No. 4,753,480 to Morell features a pad assembly for wheelchairs which includes a high density base layer and two intermediate density layers stacked upon the high density layer. The two intermediate density layers include openings and a plurality of low density inserts for insertion in the openings. In an alternate embodiment, a continuous top layer is provided which is either of the same material as the underlying intermediate layer or formed of an impact foam which form fits to the buttocks of the cushion user. The cushion assembly includes an outer cover which holds the layers and inserts in position. The cushion assembly includes a variety of different low density inserts for use in varying situations. Mini-pads formed of the same material as the bottom pad are also provided to achieve posture correction in the cushion user. The multi-unit arrangement of Morell is subject to difficulty in manufacturing and user assembly. The arrangement and compression modulus value of the pads fails to optimize comfort. In addition, the various filler pad inserts and mini-pad inserts are subject to dislocation, incorrect arrangement and are easily lost or misplaced.

U.S. Pat. No. 4,960,304 to Frantz reveals another multi-layer wheelchair cushion. The cushion includes a high density bottom layer, a similar high density mass of foam material positioned so as to cover essentially the forward half of the bottom layer. The added mass of foam material includes an inclined portion and is covered by a lower Identification Force Deflection (IFD) value top layer of foam. Between the top layer and the bottom layer, and rearward of the added mass of foam, there is positioned a fluid filled bag in communication with a valve pump. The cushion is described as being adaptable to the configuration of the person through expulsion of some of the fluid in the bag following a person sitting on the cushion. Like the cushion assembly of Morell, Frantz presents a complex assembly with a multitude of components which can become easily lost or misplaced (e.g., the valve pump). Further, the conforming steps of the cushion to Frantz would require additional work on the already overburdened personnel caring for convalescents and the like.

SUMMARY OF THE INVENTION

The present invention, on the other hand, provides a seat cushion which does not require extraneous inserts or components and yet provides a very comfortable seat cushion which positions a user so as to avoid the requirement of tight strapping. Also, in positioning the individual, the present invention provides an advantageous thigh support region which helps avoid too high a degree in tiltback of the legs of the individual using the cushion. The present invention also provides an advantageous arrangement of the cushion's three layers which are of different firmness values and density values with the upper layer including a convoluted upper surface with front depressions formed therein.

The present invention features a seat cushion which includes a first (base) layer with a front edge, a rear edge, a bottom surface and an upper surface. A second (intermediate) layer, also having a front edge, a rear edge, a bottom surface and an upper surface, is secured along its bottom surface to the upper surface of the first layer. A third (top) layer is also provided. The third layer has a front edge, a rear edge, a bottom surface and an upper surface with at least a portion of the bottom surface of the third layer secured to the upper surface of the second layer. The first, second and third layers are formed of a foam material, preferably a polyurethane foam. The first layer is formed of a foam material which is generally firmer than the second layer and the second layer is formed of a foam material which is generally firmer than the third layer. Also, the first, second and third layers are dimensioned and arranged such that the entire upper surface (excluding the depressions discussed below) of the seat cushion slopes downwardly in a direction from the front of the seat cushion to the rear of the seat cushion. The downward slope of the upper surface of the seat cushion is preferably within a range of 4.5 to 5.5 degrees and more preferably about 5.3 degrees.

The first, second and third layers are also dimensioned and arranged such that the upper surface of the seat cushion defines a pair of depressions. The depressions each originate at the front end of the seat cushion and extend rearwardly towards the rear edge of the cushion. The depressions are laterally spaced from one another between two side edges of the seat cushion such that a non-depressed forward edge region of the seat cushion is provided between and on the outer sides of the depressions.

The height of the front and rear edges of the second layer are essentially equal. Moreover, the height of the front and rear edges of the third layer are essentially equal while the front edge of the first layer is higher than the height of the rear edge of the first layer so as to form a sloping upper surface in the first layer which results in the downwardly sloping upper surface of the seat cushion and an overall wedge shape in the seat cushion.

The front edge of the seat cushion is preferably about 4 inches in height and the rear edge of the seat cushion is preferably about 2.5 inches in height. The base layer has a front edge height of about 1.5 and a rear edge height of about 0 to 0.25 of an inch. The second layer has essentially a constant thickness (e.g., 1 inch) except for the below described recessions extending rearwardly from the front edge. In addition, the seat cushion is designed such that the first layer has a maximum thickness of about $1\frac{3}{8}$ to $1\frac{5}{8}$ inches, the second layer has a maximum thickness of about $\frac{7}{8}$ to $1\frac{1}{8}$ inches and the third layer has a maximum thickness of about $1\frac{3}{8}$ to $1\frac{5}{8}$ inches. Also, the sloping base layer has a rearward edge thickness which is about 17% of the maximum thickness of the base layer (i.e., the front edge's thickness).

Unless otherwise noted, the IFD values and compression modulus values mentioned in the following sections of this application are based on measurements obtained on a solid 15"× 15"×4" block of polyurethane foam, and are not necessarily identical to values obtained on the actual convoluted layers of the present invention. These measurements are made according to ASTM D 3574-86, Test B, described further on page 10.

In a preferred embodiment, the first layer or base layer has a compression modulus value between 2.4 and 2.6, the second layer has a compression modulus value between 1.9 and 2.1, and the third layer has a compression modulus value between 2.7 and 3.3.

The density of the first layer is preferably about 2.75 to 2.85 lb/ft$^3$ the density of the second layer is preferably 1.80 to 1.90 lb/ft$^3$ the density of the third layer is preferably 2.30 to 2.40 lb/ft$^3$.

The top layer (i.e., third layer) is convoluted in checkerboard like fashion with a plurality of offset protrusions separated by valleys. The protrusions are preferably square in cross-section with sides of 1 inch and corner edges integral with one another. The valleys are 1 inch deep and, at the planar upper surface of the protrusions, the valleys define an equal area as that of the protrusions.

Recesses are formed in the front portion of the second layer so as to create the thigh depressions in the upper surface of the seat cushion. The recesses are preferably deepest at the front edge and gradually become shallower in the rearward direction. The depressions in the upper surface of the cushion thus do the same. The rearward most edge of the recesses is positioned less than half of the forward to rearward edge length of the seat cushion and preferably extend back about 30 to 45% and most preferably about 37.5% of the front to rear length of the cushion. The deepest portion of the recesses is defined by a portion of the second layer which second layer is of a thickness of about 13/16 to 15/16 of an inch and more preferably about $\frac{7}{8}$ of an inch. The minimum thickness of the second area varies from $\frac{1}{8}$ of an inch at the shallowest portion of the recess and gradually increases both rearwardly and laterally up to the surrounding thickness of the layer.

In an alternate embodiment of the invention the first and second layers have the same forward to rearward length while the third layer is at least 75% longer (more preferably 80% longer) than the front to rear length of the second and first layers so as to form a back support section in the seat cushion. The first, second and third layers are preferably secured to one another by an adhesive (e.g., RICHADH 3414 manufactured by E. R. Carpenter Company, Inc. of Richmond, Va.) or, in a less preferred embodiment, the three layers can be maintained in position by a suitable exterior covering.

BRIEF DESCRIPTION OF THE DRAWINGS

The present invention will be more fully understood from the detailed description given herein below and the accompanying drawings which are given by way of illustration only and thus are not limitative of the present invention and wherein:

FIG. 1 shows a top perspective view of a preferred embodiment of the present invention;

FIG. 2 shows a planar view of that which is shown in FIG. 1;

FIG. 6 shows a side elevational view of an alternate embodiment of the present invention;

FIG. 7 shows a front elevational view of the embodiment shown in FIG. 6;

DETAILED DESCRIPTION OF THE PREFERRED EMBODIMENTS

Figure 3:
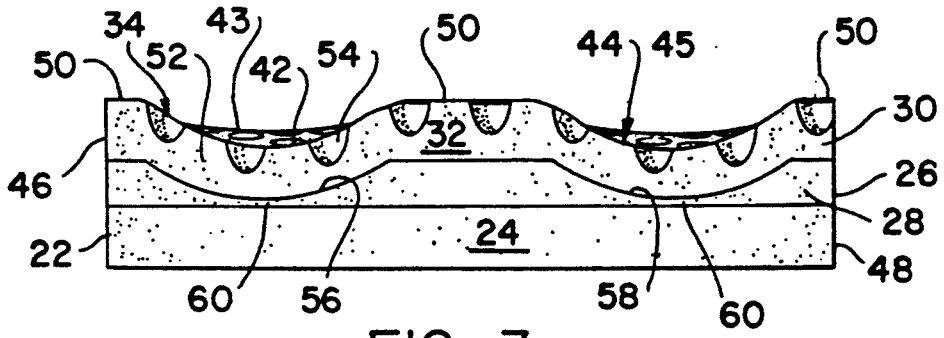
FIG. 3 shows a front elevational view of that which is shown in FIG. 1.
Figure 4:
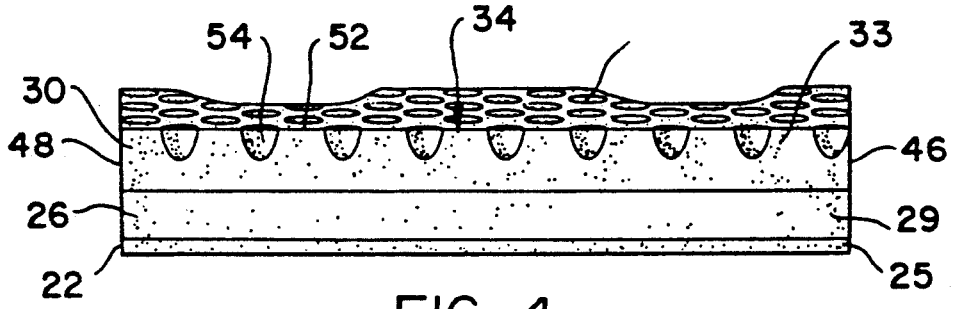
FIG. 4 shows a rear elevational view of that which is shown in FIG. 1.

FIG. 1 shows a top, perspective view of a preferred embodiment of the present invention. As shown in FIG. 1, seat cushion 20 includes a first layer 22 (i.e. base layer) having front edge 24. In a preferred embodiment, the width of front edge 24 is about 18 inches while the front to rear length of base layer 22 is about 16 inches. Base layer 22 is formed of a polyurethane foam having a density of about 2.75 lb/ft$^3$ and a compression modulus value which falls within the range of 2.4 to 2.6. The Indentation Force Deflection (IFD) values at 5%, 25% and 65% for a preferred base layer material is 19 to 24, 33 to 41 and 79 to 107. The more preferred IFD values are provided by a polyurethane foam material manufactured by E. R. Carpenter Company, Inc. and identified by the brand designation QUALUX 41.

Base layer 22 is the firmest of the three seat cushion layers (discussed herein and below) and provides a high degree of support while avoiding a "bottoming out" effect in the cushion even after extended use. The firm base also provides a foundation that helps prevent excessive side-to-side deflections in the cushion.

The aforementioned IFD values represent the amount of displacement force required to displace a solid foam pad of a 15"×15"×4" size to a predetermined percentage (e.g., 5%, 25% and 65%) of the pad's total thickness. Thus, a foam pad having an IFD value of 14 lbs for a deflection of 25% would require a load of 14 pounds to deflect a four inch thick pad one inch. The 5% IFD value is a good indication of the initial softness of the pad while the 65% IFD value provides a good indication as to the "support factor" of the pad. Typically the "support factor" of a pad is placed in terms of the compression modulus for the pad which represents the ratio of the 65% IFD value over the 25% IFD value. A pad which makes contact with a person (e.g., the top layer) should have a relatively low 5% IFD value (e.g., no more than 10) and a relatively low 25% IFD value, but a sufficiently high compression modulus (e.g., 2.7–3.3). Most solid polyurethane foams have a compression modulus value below 2.0. The higher compression modulus of the present invention is due to two factors: (1) the convoluted surface lowers the 25% IFD, making the 65%/25% ratio greater; and (2) the top layer of the present invention is made of Omalux® foam, manufactured by a patented process (U.S. Pat. No. 4,816,494) which densifies the foam during production, thereby increasing the compression modulus. The softness of a support pad is also often defined in terms of the ratio of 25% IFD value over the 5% IFD value. As it is difficult to provide IFD values for surfaces that are sloped (e.g., the base layer's upper surface), include scooped out sections (e.g., the intermediate layer's thigh recesses) or are convoluted (e.g., top layer's checkerboard convolutions), the IFD values are based on a solid 15"×15"×4" block of the material forming the layer.

Table I, however, provides a comparison between the IFD values and CM values for a solid block of the material used for the top layer and a convoluted block having the preferred dimensions and characteristics of that of the present invention.

TABLE I

| | 15" × 15" × 4" solid block | 17" × 18½" × 1⅛" convoluted block |
|---|---|---|
| 5% IFD | 7-9 | 6-7 |
| 25% IFD | 13-16 | 11-13 |
| 65% IFD | 35-53 | 28-33 |
| CM | 2.7-3.3 | 2.4-2.6 |

The manner for determining IFD values for the convoluted and non-convoluted pads of the present invention features the use of a pressure implementing device as described in ASTM D3574-86: Standard Methods of Testing Flexible Cellular Materials—Slab, Bonded, and Molded Urethane Foam (Section 16-22) which is incorporated herein by reference. In accordance with the standard method of testing, measurement means are utilized to determine when deflection of the convoluted foam cushion has reached 5%, 25% or 65% of the pad's total thickness. Deflection is achieved by controlled manipulation of a 50 $in^2$ circular pressure plate. Hence, the IFD values for 5%, 25% and 65% deflection can be determined by monitoring the force required to achieve either the 5%, 25% or 65% deflection.

Figure 5:
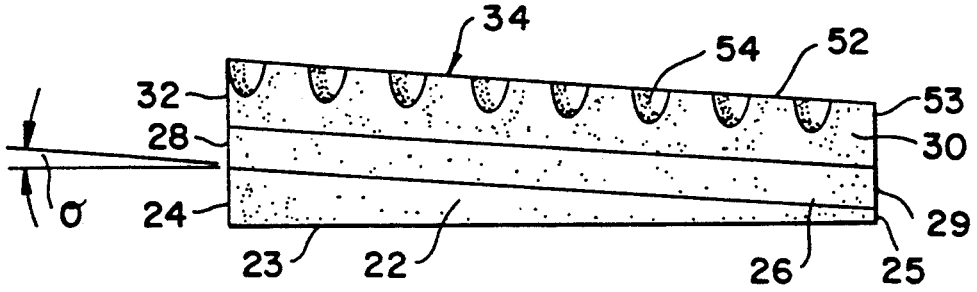
FIG. 5 shows a side elevational view of that which is shown in FIG. 1 with the opposite side (not shown) being a mirror image thereof.

As shown in FIG. 1, and more clearly in FIG. 5, base layer 22 features a planar bottom surface 23 and a perpendicularly arranged front edge 24 as well as a perpendicularly arranged rear edge 25. The vertical height of front edge 24 is larger than the vertical height of rear edge 25. Preferably, front edge 24 has a vertical height (h1+h2+h3) (FIG. 9) falling within the range of 3.75 to 4.25 while the vertical height H1 of rear edge 25 falls within the range of 2.5 to 2.75. The preferred range of the ratio h1+h2+h3/H3 is preferably about 1.25 to 1.5 with the corresponding angle designated $\sigma$ in FIG. 5 is within the range of 4.5 to 5.5 degrees and most preferably 5.3.

The Figures, particularly FIGS. 1, 3, 5, 9 and 10, illustrate intermediate layer 26 being supported by the upper surface of base layer 22. As shown in FIG. 1, the peripheral dimensions of intermediate layer 26 are essentially the same as the peripheral dimensions of base layer 22. Also, the bottom of intermediate layer 26 is preferably secured to the upper surface of base layer 22 such as by an adhesive.

Figure 9:
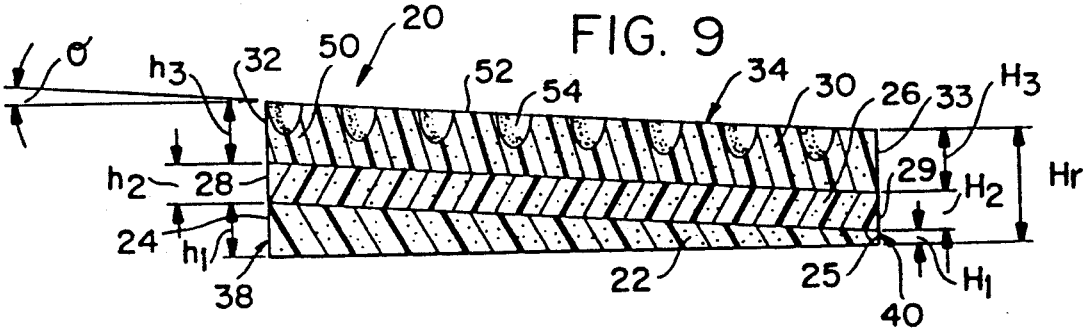
FIG. 9 shows a cross-sectional view taken along line IX—IX in FIG. 2.

FIG. 9 represents a cross-sectional view taken along cross-section line IX—IX in FIG. 2. The vertical height of intermediate layer 26 as shown FIG. 9 is designated h2 at its forward edge. The height or thickness of intermediate layer 26 (excluding recesses 56, 58—FIG. 3) is preferably the same over its front to rear length such that h2 equals H2 along cross-section line IX—IX. A suitable material for intermediate layer is a polyurethane foam sold by E. R. Carpenter Co., Inc. of Richmond, Va., under the brand designation H39XG. The intermediate layer preferably has a density of 1.8 to 1.90 $lb/ft^3$. The compression modulus values for the intermediate layer are preferably within the range of about 1.9 to 2.1. Also, the 5, 25, 65% IFD values for intermediate layer are preferably 20 to 30, 31 to 36 and 59 to 76.

Figure 10:
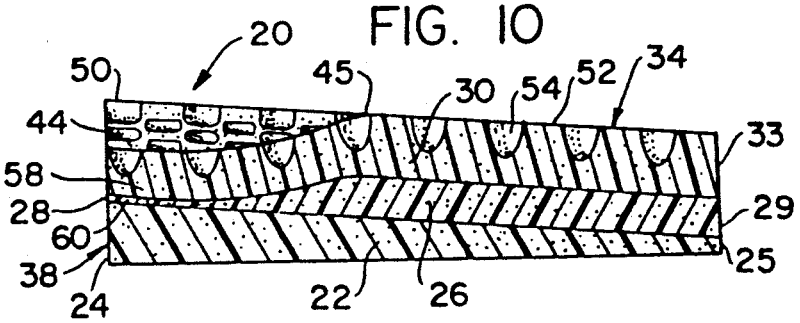
FIG. 10 shows a cross-sectional view taken along line X—X in FIG. 2.

FIGS. 1, 3 and 10 illustrate first recess 56 and second recess 58 formed in intermediate layer 26. Recesses 56 and 58 extend from the front edge 28 of intermediate layer 26 towards rear edge 29. Recesses 56 and 58 have their largest width at the front edge and gradually decrease in width in a forward to rearward direction. Recesses 56 and 58 are also concave in cross-section in a forward to rearward direction with the forwardmost portion representing the deepest portion of the recess and the rearwardmost portion representing the shallowest portion. At the forwardmost edge of intermediate layer 26, (designated 60 in FIG. 10) the recesses represent about 87% of the total thickness of intermediate layer 26 and their rearwardmost and defining side edges are coplanar with the upper surface of intermediate layer 26. Thus, the minimum thickness of intermediate layer at the recessed portion is preferably about ⅛ of an inch with the total thickness of intermediate layer being one inch. Recesses 56 and 58 also preferably extend for about 30–45% (e.g., 37.5%) of the forward to rearward length of cushion 20.

The maximum width of recesses 56 and 58 at their top, front edge is preferably about 5⅞" to 6⅛" and more preferably 6". The exterior edge of recess 56 (at its forward most point) is about 1 inch from left side 46 of cushion 20. The exterior edge of recess 58 (at its forwardmost point) is about 1 inch from right side 48. The space between the forwardmost interior edges of recesses 56 and 58 is about 4¼ inches while the rearwardmost points of recesses 56 and 58 are spaced 10 inches apart in the lateral direction. The rearwardmost points lie essentially on a line bisecting the recesses in a forward to rearward direction. Preferably, the sum of the upper forwardmost widths of recesses 56 and 58 constitutes about 65% of the entire lateral width of the front edge of cushion 20.

The figures also illustrate third (e.g., top) layer 30 having front edge 32 and rear edge 33 as well as upper surface 34. As shown in FIG. 1, top layer 30 has essentially the same peripheral dimension as intermediate layer 26 and base layer 22. Top layer 30 is secured (e.g., by adhesion) to the upper surface of intermediate layer 26.

Top layer 30 preferably has a density value of 2.3 to 2.4 $lb/ft^3$. The 5%, 25% and 65% IFD values for top layer are 7 to 9, 13 to 16 and 35 to 53. Preferred compression modulus values for top layer are 2.7 to 3.3. A suitable material for top layer 30 is a polyurethane foam (OMALUX® foam) manufactured by E. R. Carpenter Company, Inc. with the designation 01627.

Top layer 30 preferably has a thickness ($H_3=h_3$) of 1⅜ to 1⅝ and more preferably 1.5 inches. Top layer 30 features a convoluted upper surface 34 with protrusions 52 and valleys 54 arranged in a checkerboard like fashion. Protrusions 52 are preferably essentially square in cross-section with adjacent protrusions having integral corners. Protrusions preferably have sides that are $\frac{7}{8}$ to $1\frac{1}{8}$ of an inch in length and more preferably 1 inch in length. The valleys preferably extend for $37\frac{1}{2}$ to $62\frac{1}{2}$% of the total thickness of the top layer and more preferably 50%. Thus, for the most preferred 1.5 inch thickness for top layer 30, valleys 54 have a depth of $\frac{3}{4}$". Also, valleys 54 preferably define the same cross-sectional area as protrusions 52 along the upper planar surface of cushion 20.

Top layer 30 has a constant thickness throughout and thus the portions of top layer 30 secured to the recessed portions of intermediate layer 26 sink down to define first depression 42 and second depression 44. FIG. 1 illustrates that depressions 42 and 44 share essentially the same dimensions as the aforementioned recesses 56 and 58 (e.g., the upper edges of the depressions are commensurate with the underlying edges of the recesses). FIG. 1 also illustrates rearwardmost point 43 for first depression 42 and rearwardmost point 45 for second depression 45. First depression 42 also includes side edges 55 and 57 which converge inwardly to point 43. Second depression 44 includes side edges 59 and 61 which converge inwardly to point 45. From side edge 46 of cushion 20 to side edge 55 is raised, forward edge portion 50 (relative to depression 42) a similar raised, forward edge portion 50 lies between side edge 48 of cushion 20 and side edge 61 and between inner edges 59, 61 (again, relative to depressions 42, 44). Side edges 55, 57, 59 and 61 all lie on the upper, sloped planar surface of top layer 30.

FIGS. 9 and 10 further illustrate seat cushion 20 to have a planar, horizontal bottom surface and an upper surface 34 which is sloped downwardly at angle $\sigma$ in a forward to rearward direction. The angle $\sigma$ is the same as that for the downward slope of base layer 22 since intermediate layer 26 and top layer 30 are of constant thickness throughout.

Figure 8:
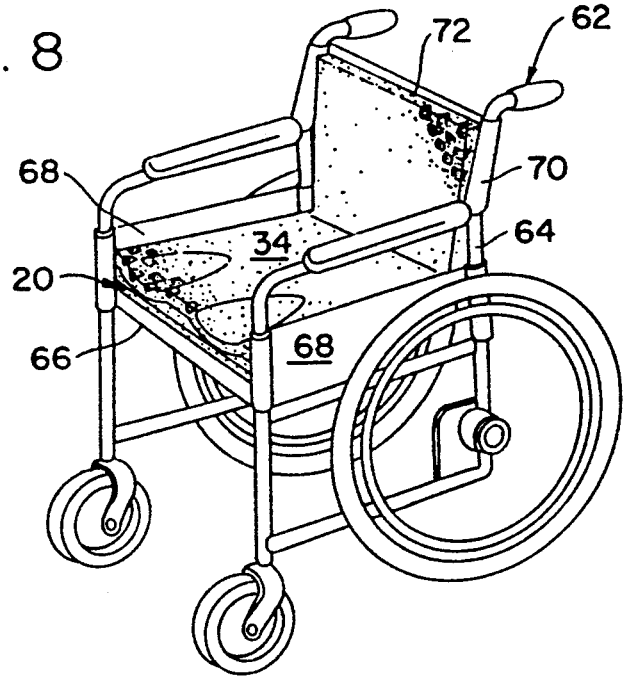
FIG. 8 shows the embodiment shown in FIG. 1 in position on a wheelchair and the modified embodiment with integral backrest (outline shown in dashed lines)

FIG. 8 shows cushion 20 in position on wheelchair 62. Wheelchair 62 is shown to include frame structure 64 supporting bottom wheelchair seat material 66, side wheelchair seat material 68 and back wheelchair seat material 70. Seat material 66, 68 and 70 maintain seat cushion 20 in position while supporting the downward and lateral loads placed on seat cushion 20. FIG. 8 also illustrates upper surface 34 of seat cushion 20 downwardly sloping from the front of wheelchair 62 to the rear of wheelchair 62. This arrangement helps maintain individuals properly positioned in wheelchair 62 and, by biasing the body rearward, helps to avoid having to tightly strap in individuals. However, so as to provide comfort and proper positioning, depressions 42 and 44 are formed in seat cushion 20 to receive the thigh regions of an individual. The depth and rearward extension of depression 42 and 44 (and likewise recesses 56 and 58) extend rearwardly a predetermined distance (e.g., 37.5%) which together with the downward slope (e.g., 5.3°) act to provide the tilt back and to avoid too high a positioning of the legs. The preferred range of angle $\sigma$ is $4\frac{1}{2}$ to $5\frac{1}{2}$ and most preferably 5.3 degrees as noted above.

FIGS. 6, 7 and FIG. 8 illustrate a second embodiment of the present invention. As shown in FIGS. 6 and 7, seat cushion 21 (the features in cushion 21 which are in common with the features in cushion 20 have been designated with corresponding primed numbers) is the same as that in the previously described embodiment except that top layer 30' includes an extension 72 so as to provide a seat cushion that supports both the back and buttocks of the individual.

FIGS. 6, 7 and 8 illustrate wheelchair back material 70 providing support to extension 72 such that extension 72 extends essentially vertical. Preferably extension 72 is integral with top layer 30' and is formed by simply elongating the cut of polyurethane foam for the top layer and adhering a forward portion to the upper surface of intermediate layer 26 and allowing the remaining rearward portion to extend off freely. The flexible extension 72 thus forms curved portion 74. The length of extension 72 from line R to its free edge is about $13\frac{1}{2}$ inches. Preferably, back extension 72 is about 74 to 78% of the front to rear length of base 22 and more preferably about 76%. Accordingly, a length of about 11 to 14 inches is suitable. FIGS. 7 and 8 illustrate the convoluted nature of extension 72 and that the lateral width of extension 72 is the same as base 22 of seat cushion 20.

FIG. 8 shows the backrest positioning of extension 72 in wheelchair 62.

Although the present invention has been described with reference to preferred embodiments, the invention is not limited to the details thereof. Various substitutions and modifications will occur to those of ordinary skill in the art, and all such substitutions and modifications are intended to fall within the spirit and scope of the invention as defined in the appended claims.

What is claimed:

1. A seat cushion, comprising:

a first layer having a front edge, a rear edge, a bottom surface and an upper surface;

a second layer having a front edge, a rear edge, a bottom surface and an upper surface with the bottom surface of said second layer supported by the upper surface of said first layer;

a third layer having a front edge, a rear edge, a bottom surface and an upper surface with at least a portion of the bottom surface of said third layer supported by the upper surface of said second layer;

said first, second and third layers being formed of a foam material, and said first layer being formed of a foam material which has different IFD values than said second layer and said second layer being formed of a foam material which has different IFD values than said third layer and said first layer being formed of a material which is different than that of said second and third layers;

said first, second and third layers being dimensioned and arranged such that an upper surface of said seat cushion slopes downwardly with respect to said bottom surface of said from the front of said seat cushion to the rear of said seat cushion with a range of $4\frac{1}{2}$ to $5\frac{1}{2}$ degrees so as to define a wedge-shaped seat cushion; and said first, second and third layers being dimensioned and arranged such that the upper surface of said sat cushion defines a pair of depressions that each originate at the front edge of said seat cushion and extend rearwardly toward the rear edge of said cushion, said depressions being laterally spaced from one another between two side edges of said seat cushion.

2. A seat cushion as recited in claim 1, wherein the upper surface of said third layer is convoluted.

3. A seat cushion as recited in claim 1, wherein the upper surface of said third layer is convoluted and includes a plurality of protrusions having integral corners and a plurality of protrusions having integral corners and a plurality of valleys positioned between said protrusions.

4. A seat cushion as recited in claim 1, wherein the first layer has a compression modulus value between 2.4 and 2.6, said second layer has a compression modulus value between 1.9 and 2.1, and said third layer has a compression modulus value between 2.7 and 3.3.

5. A seat cushion as recited in claim 1, wherein said second layer has recesses formed therein which result in said depressions in the upper surface of said seat cushions and said recesses have a maximum depth between ¾ to ⅞ inches and extend rearwardly from the front end of said seat cushion for about 35 to 45% of the front to rear length of said second layer.

6. A seat cushion as recited in claim 1, wherein said first layer has a maximum thickness of about 1⅜ to 1⅝ inches, said second layer has a maximum thickness of about ⅞ to 1⅛ inches and said third layer has a maximum thickness of about 1⅜ to 1⅝ inches.

7. A seat cushion as recited in claim 1, wherein said second layer has a pair of recesses formed therein which results in the depressions in the upper surface of said seat cushion, said recess begin of a maximum depth of about 85% to 100% of the maximum thickness of said second layer at the front edge of said second layer and lessening in depth in a front to rear direction.

8. A seat cushion as recited in claim 1 wherein each of said layers shares a common front, rear, first side and second side edge.

9. A seat cushion as recited in claim 1 wherein the first layer has a higher 65% PFD value than said second layer and a higher 65% IFD value than said third layer.

10. A wheelchair cushion as recited in claim 1, wherein said upper surface of said cushion slopes continuously from said front edge of said cushion to said rear edge of said cushion so as to form a wedge shaped seat cushion.

11. A seat cushion as recited in claim 1, wherein the height of the front and rear edges of said second layer is equal, the height of the front and rear edges of said third layer is equal, and the front edge of said first layer is higher than the rear edge of said first layer so as to form a sloping upper surface in said first layer which defines the downwardly sloping upper surface of said seat cushion.

12. A seat cushion as recited in claim 11, wherein the front edge of said seat cushion is 3¾ to 4¼ inches in height and the rear edge of said seat cushion is 2½ to 2¾ inches in height.

13. A seat cushion as recited in claim 11, wherein said first layer has a compression modulus value between 2.4 and 2.6, said second layer has a compression modulus value between 1.9 and 2.1, and said third layer has a compression modulus value between 2.7 and 3.3.

14. A seat cushion as recited in claim 13, wherein the density of said first layer is about 2.75 to 2.85 $lb/ft^3$, the density of said second layer is from 1.80 to 1.90 $lb/ft^3$ and the density of said third layer is from 2.30 to 2.40 $lb/ft^3$.

15. A seat cushion as recited in claim 1, wherein said second layer has recesses formed therein which result in the formation of the depressions in the upper surface of said seat cushion.

16. A seat cushion as recited in claim 15, wherein the upper surface of said third layer is convoluted.

17. A seat cushion as recited in claim 15, wherein the rearward most edge of said depressions is positioned less than half of the distance between the front edge and the rear edge of said seat cushion.

18. A seat cushion as recited in claim 1, wherein said third layer is at least 35% longer in a front to rear direction than said first and second layers so as to form a back support section in said seat cushion.

19. A seat cushion as recited in claim 18, wherein the upper surface of said third layer is convoluted.

20. A seat cushion as recited in claim 19, wherein the convoluted upper surface includes a plurality of protrusions having integral corners and a plurality of valleys positioned between said protrusions.

21. A wheel chair cushion, comprising:

a base layer formed of a foam material and having a bottom surface and an upper surface which slopes downwardly with respect to said bottom surface in a front to rear direction;

an intermediate layer formed of a foam material and secured to the upper surface of said base layer, said intermediate layer having a front edge, a rear edge and two side edges with the rear and two side edges being essentially of the same height, a pair of laterally spaced recesses being formed in said intermediate layer between said two side edges and extending form the front edge toward the rear edge of said second layer;

a top layer formed of a foam material and secured to the upper surface of said intermediate layer and extending into the recesses formed in said intermediate layer so as to define a pair of depression formed in an upper surface of said seat cushion; and said base layer being firmer than said top and intermediate layers.

22. A wheel chair cushion as recited in claim 21 wherein said seat cushion has an upper surface which slopes downwardly with respect to said bottom surface of said base layer at an angel from about 4.5° to 5.5°.

23. A wheel chair cushion as recited in claim 21, wherein the upper surface of said top layer is convoluted and said to player is of constant thickness.

24. A wheel chair cushion as recited in claim 23, wherein a solid block of the material forming said intermediate layer has a 65% IFD value, which is higher than a similar shaped solid block of the material forming said top layer, and a similar solid shaped block of the material forming said base layer has a higher 65% IFD value than said block of the material forming said intermediate layer.

25. A wheel chair cushion, comprising a base layer having a front edge and a rear edge;

an intermediate layer secured to an upper surface of said base layer;

a top layer having a bottom surface partially supported by said intermediate layer, said to player including an extended portion extending out away from the intermediate layer, said extended portion being dimensioned and arranged for use as a wheel chair backrest cushion member so as to provided a backrest support when said wheelchair cushion is supported by a wheelchair, and wherein said top layer is at least 35% longer in a front to rear direction than said intermediate layer.

26. A wheelchair cushion as recited in claim 25 wherein said top layer has a convoluted upper surface.

27. A wheelchair cushion as recited in claim 25 wherein said base layer is formed of polyurethane foam material with the front edge being higher than the rear edge so as to form a wedge shaped layer.

28. A wheelchair cushion as recited in claim 25 wherein a solid block of the material forming said top layer has a 65% IFD value which is less than the 65% IFD value of a solid block of the material forming said intermediate layer and said base layer.

29. A wheelchair cushion as recited in claim 28 wherein said wheelchair cushion has an upper surface which slopes downwardly with respect to a bottom surface of said base layer form a forward edge of said cushion toward the backrest portion.

30. A seat cushion, comprising:

a first layer having a front edge, a rear edge, a bottom surface and an upper surface;

a second layer having a front edge, a rear edge, a bottom surface and an upper surface with the bottom surface of said second layer supported by the upper surface of said first layer;

a third layer having a front edge, a rear edge, a bottom surface and an upper surface with at least a portion of the bottom surface of said third layer supported by the upper surface of said second layer;

said first, second and third layers being formed of a foam material, and said first layer being formed of a foam material which has different IFD values than said second layer and said second layer being formed of a foam material which has different IFD values than said third layer;

said first, second and third layers begin dimensioned and arranged such that an upper surface of said seat cushion slopes downwardly in a direction from the front of said seat cushion to the rear of said seat cushion within a range of b 4½ to 5½ degrees; and said first, second and third layers being dimensioned and arranged such that the upper surface of said seat cushion defines a pair of depressions that each originate at the front edge of said seat cushion an extend rearwardly toward the rear edge of said cushion, said depressions being laterally spaced from one another between two side edges of said seat cushion and said second layer has a recesses formed therein which result in the formation of the depression in the uppers surface of said seat cushion, and said rearward most edge of said depressions is positioned less than half of the distance between the front edge and the rear edge of said seat cushion.

31. A seat cushion, comprising:

a first layer having a front edge, a rear edge, a bottom surface and an upper surface;

a second layer having a front edge, a rear edge, a bottom surface and an upper surface with the bottom surface of said second layer supported by the upper surface of said first layer;

a third layer having a front edge, a rear edge, a bottom surface and an upper surface with at least a portion of the bottom surface of said third layer supported by the upper surface of said second layer;

said first, second and third layers being formed of a foam material , and said first layer being formed of a foam material which has different IFD values than said second layer and said second layer being formed of a foam material which has different IFD values than said third layer;

said first, second and third layers being dimensioned and arranged such that an upper surface of said seat cushion, slopes downwardly with resect to a bottom surface of said seat cushion in a direction from a front edge of said seat cushion, and said upper surface of said seat cushion slopes downwardly from a starting location at said front of said seat cushion edge to an ending location at a rear of said seat cushion edge so as to define a wedge shaped seat cushion; and said first, second and third layers begin dimensioned and arranged such that the upper surface of said seat cushion defines a pair of depressions that each originate at the front edge of said seat cushion and extend rearwardly toward the rear edge of said cushion, and wherein a rearward most edge of each of said depressions is positioned less than half the distance between the front edge and rear edge of said seat cushion, said depressions being laterally spaced from one another to opposite sides of an intermediate portion of the front edge of said seat cushion and between two side edges of said seat cushion.

* * * * *